United States Patent [19]

Konta et al.

[11] Patent Number: 4,702,720

[45] Date of Patent: Oct. 27, 1987

[54] TRICK VEHICLE CAPABLE OF JUMPING

[75] Inventors: Yukio Konta; Yosuke Yoneda, both of Tokyo, Japan

[73] Assignee: Tomy Kogyo Co. Inc., Tokyo, Japan

[21] Appl. No.: 825,853

[22] Filed: Feb. 4, 1986

Related U.S. Application Data

[63] Continuation of Ser. No. 602,610, Apr. 20, 1986.

[30] Foreign Application Priority Data

Aug. 2, 1983 [JP] Japan ..... 58-119870[U]

[51] Int. Cl.[4] ..... A63H 17/26

[52] U.S. Cl. ..... 446/448; 446/466; 446/310; 446/437

[58] Field of Search ..... 446/308, 310, 453, 489, 446/429, 430, 437, 470, 462, 466, 6, 174

[56] References Cited

U.S. PATENT DOCUMENTS

| | | | |
|---|---|---|---|
| 949,544 | 2/1910 | Muehlstein | 446/310 |
| 2,182,642 | 12/1939 | Rexford | 446/437 |
| 3,720,019 | 3/1973 | Waznys et al. | 446/174 |
| 3,772,824 | 11/1973 | Terzian et al. | 446/437 |
| 3,859,752 | 1/1975 | Morrison | 446/6 |
| 4,246,719 | 2/1981 | Kulesza | 446/310 |
| 4,276,717 | 7/1981 | Zbriger et al. | 446/437 |
| 4,295,292 | 10/1981 | Fitzgerald et al. | 446/6 |
| 4,453,340 | 6/1984 | Kozuka et al. | 446/437 |
| 4,516,952 | 5/1985 | Brand et al. | 446/466 |

FOREIGN PATENT DOCUMENTS

| | | | |
|---|---|---|---|
| 217576 | of 1924 | United Kingdom | 446/437 |

*Primary Examiner*—Robert A. Hafer
*Assistant Examiner*—Samuel Rimell
*Attorney, Agent, or Firm*—Herb Boswell

[57] ABSTRACT

A toy wheeled vehicle includes an inertial element located so as to move between two positions. A spring is associated with the inertial element to accelerate it from its first position to its second position. When the element reaches its second position the force of the acceleration is transferred to the vehicle chassis and the vehicle chassis "jumps" in response to the force.

12 Claims, 5 Drawing Figures

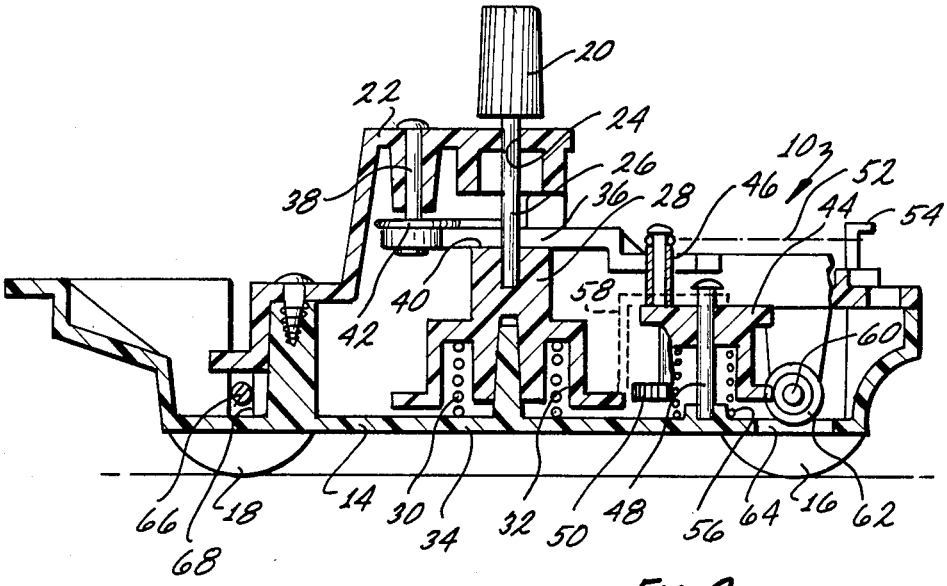
FIG. 3
FIG. 4
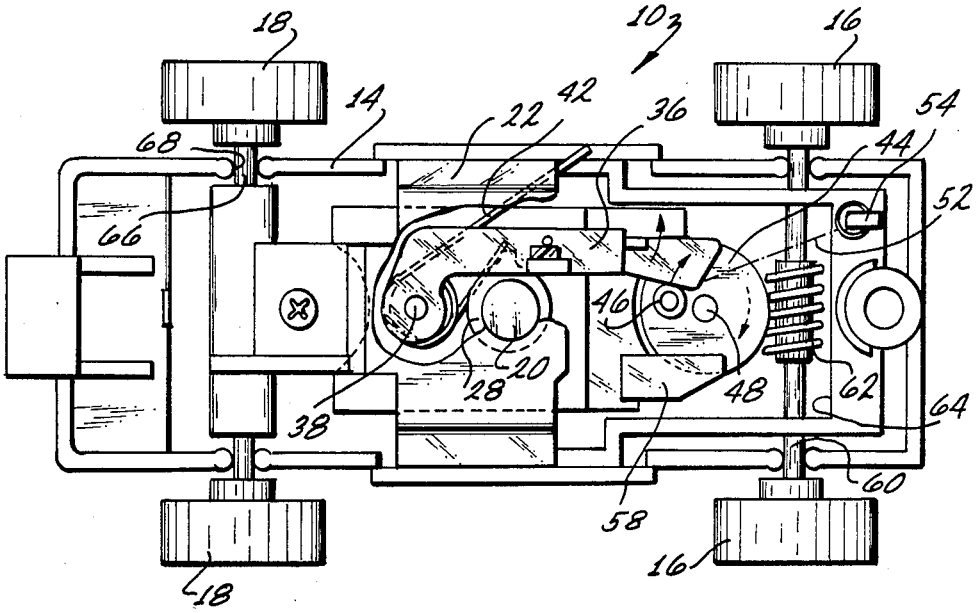

TRICK VEHICLE CAPABLE OF JUMPING

This is a continuation, of application Ser. No. 602,610 filed Apr. 20, 1986.

BACKGROUND OF INVENTION

This invention is directed to a toy vehicle capable of rolling on a support surface and further of executing a jumping motion from said support surface.

A class of toy vehicles are known which have a member which is capable of moving downwardly toward a support surface and contacting the support surface. In response to contact of the member with the support surface the vehicle or other toy is raised or otherwise moved with respect to the support surface. Vehicles of this type are known wherein the contact member causes rotation of the vehicle about the center of rotation of one of its axles to lift either the front or the back end of the vehicle up. A further of these types of toy vehicles locates the member to one side or the other of the vehicle such that upon contact of the member on the support surface one side or other of the vehicle is elevated with respect to the other side to essentially tip the vehicle sideways.

Some of the vehicles noted in the previous paragraph are capable of being completely flipped over such that they roll about portions of their outer body doing summersault like moves. For the most part the vehicles which are capable of rolling utilize a member which contacts a support surface and then, in a controlled manner, is further extended from the vehicle to slowly roll the vehicle on the support surface. A number of other vehicles, however, utilize a member which is violently or very rapidly thrust towards the support surface such that the vehicle very dramatically is flipped or upset.

Many children are fascinated with toy vehicles which are capable of jumping over obstacles and the like. Because of this a variety of toy vehicles have been produced which are used in association with ramps or other jumping apparatus which allows the toy to fly through space in much the same manner as certain stunt cars do in auto stunt shows and the like. These toys, however, all require the use of ramps, tracks, or other accessory items for them to perform their "jump" or other airborne antics.

Thus toys are known which are capable of jumping or being airborne but these required the use of ramps or other accessories. Further, toys are known which are capable of flipping or exhibiting erratic motions. However, for the most part these erratic motions are limited to motions which will lift a portion of the toy above the support surface, roll the toy over certain of its body surfaces or simply cause it to oscillate up and down. These known motions are not of a nature which will actually render the toy airborne in a known and predictable manner as with jumping ramps and the like.

BRIEF SUMMARY OF THE INVENTION

In view of the above it is a broad object of this invention to provide a new type of toy trick vehicle which is capable of rolling in a normal manner but which is further capable of performing jumps or other airborne motions without the utilization of ramps or other accessories. It is a further object of this invention to provide for a trick toy vehicle which does not rely on the use of members or other elements of the toy which must be extended away from the toy to contact a support surface in order to move the toy with respect to this support surface. It is a further object of this invention to provide a new trick toy vehicle, which because of its engineering principles and simplicity of the same is capable of performing the above noted motions yet is still susceptible to economic production of the same so as to be conveniently and economically available to the consuming public.

These and other objects as will be evident from the remainder of this specification are achieved in a toy vehicle which comprises: a vehicle chassis; a plurality of wheels mounted on said chassis in a position to contact a support surface, said vehicle moving on said support surface by rolling on said wheels; an element movably located on said chassis so as to move on said chassis between a first position and a second position, said element in said second position contacting a portion of said chassis; force means located on said chassis in operative association with said element, said force means for accelerating said element from said first position towards said second position and when so accelerated said element moving from said first position to said second position and contacting said portion of said chassis and transferring said force of said acceleration to said chassis to move said chassis with respect to said support surface; control means operatively associated with said element and said force means, said control means for controlling the acceleration of said element by said force means.

In a preferred embodiment of the toy these and other objects are achieved in a toy which comprises a vehicle chassis; a plurality of wheels mounted on said chassis in a position to contact a support surface, said vehicle moving on said support surface by rolling on said wheels; an element movably located on said chassis so as to move on said chassis between a first position and a second position, said element in said second position contacting a portion of said chassis; force means located on said chassis in operative association with said element, said force means for accelerating said element from said first position towards said second position and when so accelerated said element moving from said first position to said second position and contacting said portion of said chassis and transferring said force of said acceleration to said chassis to move said chassis with respect to said support surface; control means operatively associated with said element and said force means, said control means for controlling the acceleration of said element by said force means.

BRIEF DESCRIPTION OF THE DRAWINGS

This invention will be better understood when taken in conjunction with the drawings wherein:

FIG. 3 is a side elevational view of the components of the toy seen in FIG. 2;

FIG. 4 is a top plan view in partial section of the components of the toy as seen in FIG. 2.

Figure 1:
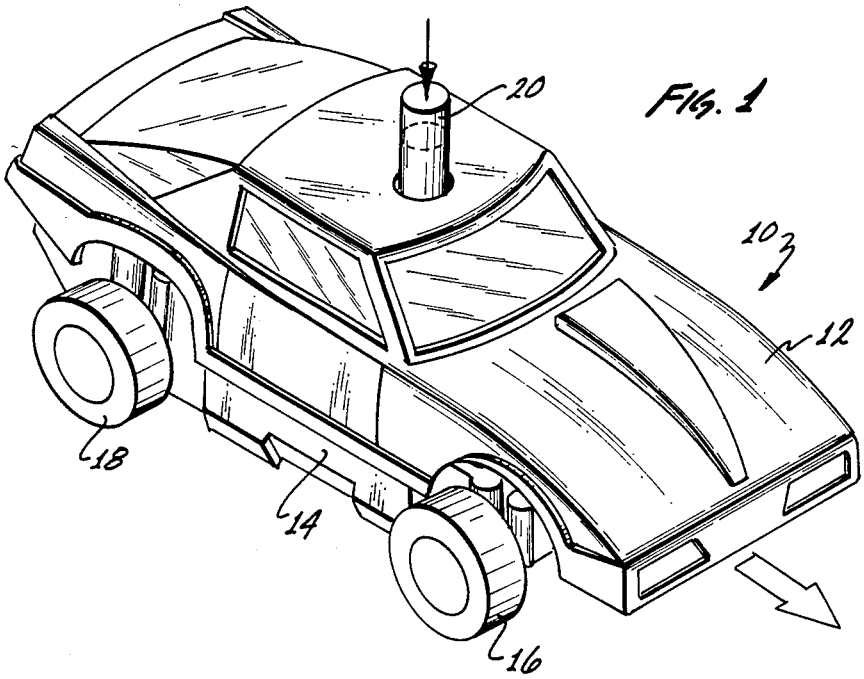
FIG. 1 is an isometric view of a toy vehicle of this invention.

The invention described in this specification and shown in the drawings utilizes certain principles and/or concepts as are set forth in the claims appended to this specification. Those skilled in the toy arts will realize that these principles and/or concepts are capable of being utilized in a variety of embodiments which might differ from the illustrative embodiments herein. For this reason this invention is not to be construed as being limited to only the illustrative embodiments but should only be construed in view of the claims.

DETAILED DESCRIPTION

In the figures there is shown a vehicle 10 which has a body shell 12 mounted onto a chassis 14 having front wheels collectively identified by the numeral 16 and rear wheels collectively identified by the numeral 18. On top of the body shell 12 is an activation button 20.

In operation, the activation button 20 is depressed inwardly into the body shell 12. The vehicle 10 is then propelled across a support surface by giving the vehicle a push or shove or the like. As the vehicle rolls across the support surface after a predetermined distance, as hereinafter explained, the vehicle forceably lifts or jumps from the support surface and becomes airborne for a sort period of time and then returns to the support surface. In one embodiment of the invention shown in FIGS. 1 through 4 certain mechanisms within the interior of the toy are so located that the toy essentially jumps upwardly and then lands back down on all four of its wheels so that it can continue rolling. In other embodiments of the invention, as hereinafter explained, certain of the components in the interior of the toy can be repositioned to different locations such that the toy will perform different motions such as doing a flip or the like.

Figure 2:
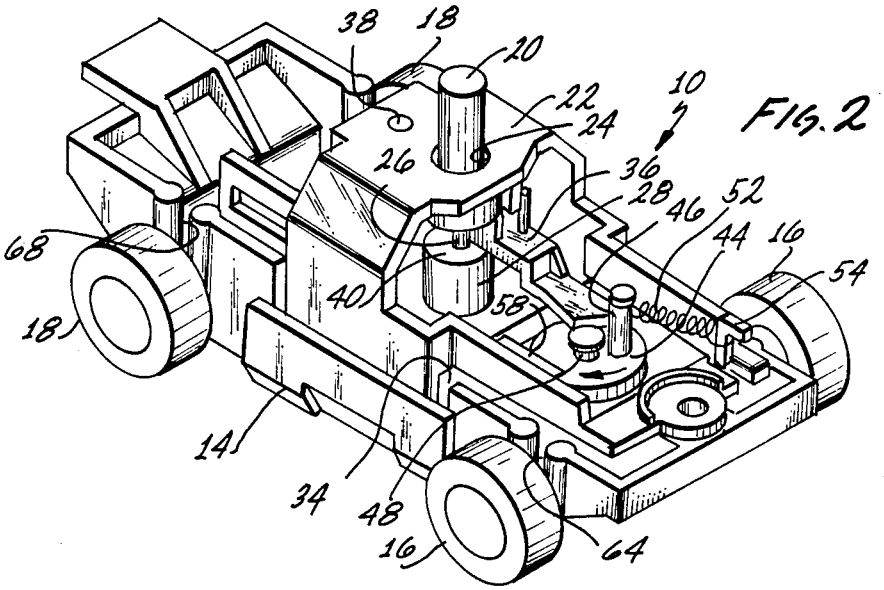
FIG. 2 is an isometric view of the toy vehicle of FIG. 1 with certain outside housing members removed so as to show operational parts located within the interior of the toy.

Referring now to FIG. 2, the body shell 12 has been removed from the toy vehicle 10 to illustrate certain of the internal components. A U-shaped member 22 projects upwardly and across the top of the chassis 14. It includes an opening 24 in its top surface which serves as a guide or pilot hole for a shaft 26 which is attached to the bottom of the activation button 20. Located on the lower end of the shaft 26 is an inertial mass element 28. The element 28 is preferredly formed of a metal or other dense material such that it has a substantial mass compared to the remainder of the chassis 14 and body shell 12 which are preferredly formed of a plastic or the like material.

A strong compression spring 30 is located within a channel 32 within the mass element 28. The spring 30 is compressed between the bottom wall 34 of the chassis 14 and the bottom of the inverted channel 32. The spring 30 biases or urges the mass element 28 upwardly toward the top of the U-shaped member 22.

A retaining member 36 is pivoted via a pin 38 to the underside of the U-shaped member 22. The retaining member 36 essentially pivots horizontally toward and away from the shaft 26. The mass element 28 includes a shoulder 40 which can catch underneath the retaining member 36 when the retaining member 36 is pivoted towards the shaft 26. When the retaining member 36 is pivoted away from the shaft 26 it clears the shoulder and allows the mass element 28 to be lifted upwardly by the spring 30.

A hairpin spring 42 is connected at one of its ends to the retaining member 36 and at the other of its ends to the U-shaped member 22. It is compressed so that the spring 42 urges the retaining member 36 toward the shaft 26. Because of this when the mass element 28 is pressed downwardly by pushing down on the activation button 20 compressing the spring 30, the retaining member 36 swings over toward the shaft 26 to lock on top of the shoulder 40 to hold the mass element 28 downwardly with the spring 30 in a compressed or biased position.

A drum 44 having a crank pin 46 on its upper surface is rotatably mounted via pin 48 to the bottom wall 34 of the chassis 14. The drum 44 includes a spur gear 50 along its lower periphery. The drum 44 and the spur gear 50 are formed as an integral unit such that the crank pin 46 rotates with respect to rotation of the spur gear 50. A spring 52 connects between the crank pin 46 and a tab 54 which is formed as a part of the chassis 14. This essentially biases the drum to the position shown in FIG. 2.

The drum 44 has a hollow interior. To receive a compression, spring 56 fits underneath the drum 44 and contacts the bottom wall 34 of the chassis 14 so as to bias the drum 44 upwardly until it engages the head of the pin 48. The mass element 28 includes an extension 58 on its forward edge which projects over the edge of the drum 44. When the activation button 20 is depressed the extension 58 contacts the drum 44 and depresses it downwardly against the bias of the spring 56.

The front wheels 16 are mounted about an axle 60 which includes a worm gear 62 fixedly located thereon. The axle 60 fits into elongated slots 64 on the left and right hand side of the chassis 14 which allows the axle 60 to move upwardly and downwardly a small increment of distance with respect to the chassis 14. Likewise the rear wheels 18 are mounted to an axle 66 which are also located in slots 68 such that the rear wheels and their axles 66 can also move upwardly and downwardly through a short increment of distance.

When the vehicle 10 is placed on a support surface the weight of the vehicle 10 causes the chassis 14 to move downwardly with respect to the axle 60 and 66 such that they are located in the top of their respective slots 64 and 68. If the activation button 20 is depressed the inertial mass element 28 is depressed and its extension 58 contacts the top of the drum 44 pushing the drum 44 downwardly such that the spur gear 50 engages the worm gear 62 on the axle 60. Rotation of the axle 60 in response to rotation of wheels 16 rotates the worm gear 62 which in turn rotates the spur gear 50. The rotation of the spur gear 50 rotates the drum 44 clockwise as is seen in FIG. 4.

As the drum 44 rotates when it nears the position as shown in FIG. 4 the crank pin 46 contacts the retaining member 36 and further rotation of the drum 44 moves the retaining member 36 such that it pivots about the pin 38 and compresses the hairpin spring 42. This moves the retaining member 36 in a direction away from the shaft 26 such that eventually it is moved sideways off of shoulder 40 allowing the inertial mass element 28 to be forcefully accelerated upwardly by the spring 30. As the mass element 28 moves upwardly it eventually contacts the underside of the U-shaped member 22 and the momentum of the mass element 28 under the acceleration imparted to it by the spring 30 is transferred to the member 22 which in turn transfers it to the chassis 14 and the remainder of the vehicle 10. The vehicle 10 then is accelerated upwardly by the force imparted to it by the movement of the mass element 28.

When the mass element 28 moves upwardly under the force of the spring 30 its extension 58 moves upwardly with respect to the drum 44 allowing the spring 56 to move the drum upwardly until the spur gear 50 on the drum 44 is no longer in a position to contact the worm gear 62 on the axle 60. When the vehicle 10 descends downwardly to the support surface the axle 60 is free to rotate and any forward momentum still imparted into the vehicle 10 by its initial forward push continues to propel the vehicle 10 forward. As such the vehicle 10 is first driven forward, then it jumps or hops and becomes airborne and when it lands it continues in its forward movement until all of its momentum is lost.

The spring 52 repositions the drum 44 into the position essentially seen in FIG. 2 after each mode of operation. Further, if the activation button 20 is depressed such that the inertial mass element 20 becomes locked under the retaining member 36 it will be retained in this position until the retaining member 36 is moved by the crank pin 46. If the vehicle 10 is only moved forward a short increment, the interaction of the worm gear 62 with the spur gear 50 will only partially rotate the drum 44 from the position seen in FIG. 2 to the position seen in FIG. 4. If the vehicle is then lifted from the support surface the front axle 60 will drop which disengages the worm gear 62 from the spur gear 50 and allows the drum 44 to rotate under the influence of the spring 52. Whether or not the drum 44 rotates counterclockwise or clockwise depends upon the exact location of the crank pin 46. If the crank pin 46 is off center to one side or the other from the line passing through the pin 48 and the spring 56 it will rotate to one side or the other depending upon which side it is on. As such the operator of the vehicle 10 will not know whether or not the drum 44 has rotated back to its initial position or whether it has come to rest against the retaining member 36. The spring 52 is normally chosen to be of such a strength that it in itself is not capable of moving the retaining member 36 but requires rotation of the drum 44 by the axle 60 in order to move the retaining member 36 against the bias of the hairpin spring 42. As such the operator of the toy can physically move the vehicle 10 forward an increment and then give it a small shove. If the drum 44 had returned to its starting position as in FIG. 2 the vehicle must travel a longer distance before it jumps. If the drum had rotated under the influence of spring 52 to the position shown in FIG. 4 it will execute its jumping motion almost immediately upon initialization of its forward rolling motion.

When the drum 44 is in its upward position against the head of its pin 46 the spur gear 50 is lifted upwardly out of range of contact with the worm gear 62. As such in this mode of operation the vehicle 10 is freewheeling and can be played with in a normal manner like any freewheeling vehicle. It is only when the drum 44 is depressed downwardly by the extension 58 of the inertial mass element 28 and the worm gear 62 is lifted upwardly when the front axle 60 is in the upward end of travel within the slots 64 that the worm gear 62 can engage the spur gear 50. The remainder of the time the vehicle is free wheeling.

Figure 5:
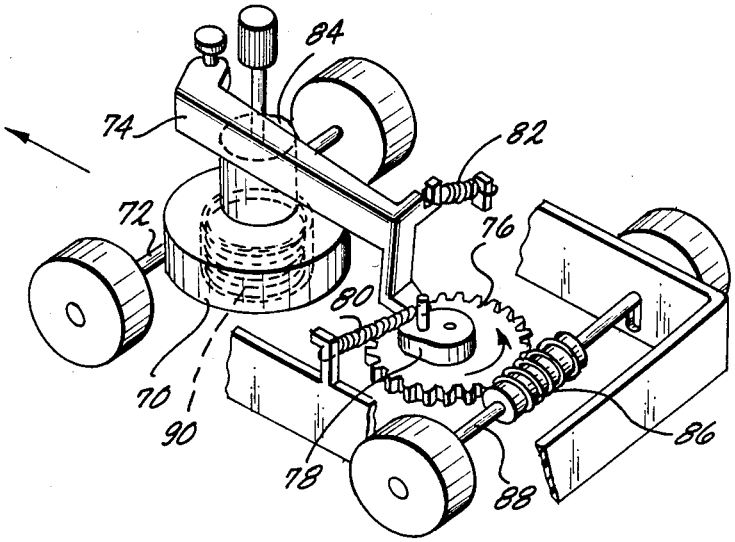
FIG. 5 is an exploded fragmentary view of certain internal components of an alternate embodiment of the toy.

A further embodiment of the toy is shown in FIG. 5. In this embodiment of the toy the inertial mass element 70 is moved forward such that it is placed just slightly behind the front axle 72. The retaining member 74 is pivotally mounted near the front of the vehicle and in place of a drum 44 a large spur gear 76 is utilized which incorporates a cam 78 on its surface. A spring 80 is utilized to position the spur gear 76 and cam 78 as per the spring 52. Further a spring 82 is utilized to position the retaining member 74 over the shoulder 84 of the inertial mass member 70. A worm gear 86 is located on the rear axle 88 to rotate the spur gear 76 counterclockwise. This causes the cam 78 to engage the end of the retaining member 74 to rotate it such that the inertial mass element 70 is free to be accelerated upwardly by a spring 90 located between it and the chassis 14.

Because the inertial mass element 70 is located near the front of the vehicle as opposed to the center position of the previously described inertial mass element 28 within the vehicle 10, when the vehicle of FIG. 5 is operated, upon acceleration of the inertial mass element 70 upwardly against the chassis of the vehicle of FIG. 5 the front end of the vehicle will be given a greater momentum than the back end of the vehicle such that the vehicle will do a flip instead of a straight upward jump.

It is obvious that in place of locating an inertial mass element 28 in the center of the vehicle as per the first embodiment or the inertial mass element 70 in the front of the vehicle as per the embodiment in FIG. 5 it could be placed near the rear of the vehicle or to one side or the other with a resulting movement of the vehicle corresponding to placement of the inertial mass element.

I claim:

1. A toy vehicle which comprises:

a vehicle chassis;

a plurality of wheels mounted on said chassis in positions to contact a support surface, said vehicle moving on said support surface by rolling on said wheels;

an axle, at least one of said wheels attaching to said axle, said axle being rotatively mounted on said chassis for rotation on said chassis, said axle rotated on said chassis in response to rotation on said support surface of said one of said wheels attached to said axle;

a chassis extension fixedly attaching to said vehicle chassis and stationary with respect to said vehicle chassis, said chassis extension including an elevated portion located in an elevated position above said chassis;

an inertial element movably located on said chassis below said elevated portion of said chassis extension, said element vertically movable on said chassis between a locked position and a position wherein said element contacts said elevated portion of said chassis extension;

force means located on said chassis in operative association with said element, said force means for accelerating said element upwardly from said locked position towards said elevated portion of said chassis extension whereby said element contacts said elevated portion of said chassis extension and transfers the force of said acceleration to said chassis to move said chassis with respect to said support surface;

a retaining member movably located on said chassis in operative association with said element so as to move with respect to said element between a position where said retaining member holds said element in said locked position and a position wherein said retaining member releases from said element allowing said element to be moved from said locked position by said force means;

a rotating member movably mounted on said chassis, said rotating member vertically movable on said chassis between an elevated position and a depressed position;

biasing means located on said chassis in operative association with said rotating member;

said rotating member in operative association with said element whereby said element operatively contacts said rotating member and holds said rotating member in its depressed position when said element is in its locked position and said element releases from said rotating member when said element moves towards its elevated position and in response to said element releasing from said rotating member said biasing means moving said rotating member to its elevated position;

said rotating member further in operative association with said retaining member so as to move said retaining member;

rotation transfer means for transfering rotation, said rotation transfer means operatively associated with both said axle and said rotating member so as to transfer rotation of said axle to said rotating member when said rotating member is in its depressed position, whereby in response to rotation of said axle, said rotation transfer means rotating said rotating member, said rotation moving said retaining member with respect to said element releasing said retaining member from said element such that said element moves from said locked position towards said elevated portion of said chassis extension.

2. The toy of claim 1 including:

said retaining member being pivotably mounted on said chassis to move horizionally on said chassis.

3. The toy of claim 2 including:

retaining member biasing means for biasing said retaining member towards said element.

4. The toy of claim 1 including:

activation means operatively attaching to said element, said activation means for moving said element to its locked position.

5. The toy of claim 4 wherein:

said activation means comprises a shaft attaching to said element and extending upwardly from said element to a position operated on by an operator of said toy.

6. The toy of claim 5 including:

said chassis extension comprises a U-shaped extension of said chassis, said U-shaped extension including an opening, said shaft passing through said opening such that a portion of said shaft is located above said U-shaped extension.

7. A toy vehicle which comprises:

a vehicle chassis;

a plurality of wheels mounted on said chassis in positions to contact a support surface, said vehicle moving on said support surface by rolling on said wheels;

an axle, at least one of said wheels attaching to said axle, said axle being rotatively mounted on said chassis for rotation on said chassis, said axle rotated on said chassis in response to rotation on said support surface of said one of said wheels attached to said axle;

a worm gear fixedly mounted on said axle to rotated in response to rotation of said axle;

a chassis extension fixedly attaching to said vehicle chassis and stationary with respect to the remainder of said vehicle chassis, said chassis extension including an elevated portion located in an elevated position above said chassis;

an inertial element movably located on said chassis below said elevated portion of said chassis extension, said element vertically movable on said chassis between a locked position and a position wherein said element contacts said said elevated portion of said chassis extension;

force means located on said chassis in operative association with said element, said force means for accelerating said element upwardly from said locked position towards said elevated portion of said chassis extension whereby said element contacts said elevated portion of said chassis extension and transfers the force of said acceleration to said chassis to move said cha1ssis with respect to said support surface;

a retaining member movably located on said chassis in operative association with said element so as to move with respect to said element between positions where said retaining member holds said element in said locked position and releases from said element allowing said element to be moved from said locked position by said force means;

a rotating member movably mounted on said chassis, said rotating member including a gear located thereon, said gear operatively connectable to said worm gear so as to rotated by said worm gear;

said rotating member in operative association with said retaining member so as to move said retaining member;

in response to rotation of said axle, said worm gear rotating said rotating member, said rotation of said rotating member moving said retaining member with respect to said element releasing said retaining member from said element such that said element moves from said locked position towards said elevated portion of said chassis extension.

8. The toy of claim 7 including:

said retaining member being pivotably mounted on said chassis to move horizionally on said chassis.

9. The toy of claim 8 including:

retaining member biasing means for biasing said retaining member towards said element.

10. The toy of claim 7 including:

activation means operatively attaching to said element, said activation means for moving said element to its locked position.

11. The toy of claim 10 wherein:

said activation means comprises a shaft attaching to said element and extending upwardly from said element to as position so a to operated on by an operator of said toy.

12. The toy of claim 11 including:

said chassis extension comprises a U-shaped extension of said chassis, said U-shaped extension including an opening, said shaft passing through said opening such that a portion of said shaft is located above said U-shaped extension.

* * * * *